US009414983B1

(12) United States Patent
Loli et al.

(10) Patent No.: US 9,414,983 B1
(45) Date of Patent: Aug. 16, 2016

(54) ADJUSTABLE PATIENT ARM SUPPORT SYSTEM

(71) Applicants: Akil Loli, Paradise Valley, AZ (US); Gary Schwartz, Phoenix, AZ (US)

(72) Inventors: Akil Loli, Paradise Valley, AZ (US); Gary Schwartz, Phoenix, AZ (US)

(73) Assignee: AG Technical Solutions, LLC, Paradise Valley, AZ (US)

( * ) Notice: Subject to any disclaimer, the term of this patent is extended or adjusted under 35 U.S.C. 154(b) by 0 days.

(21) Appl. No.: 14/863,699

(22) Filed: Sep. 24, 2015

(51) Int. Cl.

| | |
|---|---|
| ***A61G 13/12*** | (2006.01) |
| ***A61G 7/075*** | (2006.01) |
| ***A61G 7/10*** | (2006.01) |
| *A61G 13/00* | (2006.01) |

(52) U.S. Cl.
CPC ..... *A61G 13/1235* (2013.01); *A61G 7/075* (2013.01); *A61G 7/1092* (2013.01); *A61G 2013/0045* (2013.01)

(58) Field of Classification Search
CPC ..... A61G 7/00; A61G 7/002; A61G 7/015; A61G 7/065; A61G 7/075; A61G 7/1082; A61G 7/1092; A61G 13/00; A61G 13/08; A61G 13/12; A61G 13/1235; A61G 2013/0045
USPC ..... 128/845, 877; 5/600, 613, 621, 623, 5/630, 646
See application file for complete search history.

(56) References Cited

U.S. PATENT DOCUMENTS

| | | | | |
|---|---|---|---|---|
| 3,528,413 | A * | 9/1970 | Aydt | A61F 5/013 24/569 |
| 4,265,232 | A | 5/1981 | Stonich | |
| 4,369,774 | A | 1/1983 | Robbins | |
| 6,195,820 | B1 * | 3/2001 | Heimbrock | A61G 13/12 403/68 |
| 8,369,933 | B2 | 2/2013 | Crisco | |
| 8,700,131 | B2 | 4/2014 | Goff | |
| 8,875,329 | B2 | 11/2014 | Gomez | |
| 2014/0221811 | A1 | 8/2014 | Sampognaro | |
| 2014/0289965 | A1 * | 10/2014 | Wheeler | A61G 13/12 5/621 |

OTHER PUBLICATIONS

Web page: http://www.medicus-health.com/lollipop-arm-board.aspx, printed Aug. 17, 2015.
Merit Medical Rad Board Web page: http://radialassist.com/products.html, printed Aug. 17, 2015.
STARBoard Product Brochure; found at http://www.adeptmedical.co.nz/pages/starboard; accessed and downloaded Aug. 17, 2015.
VSI Radial Arm Board Instructions for Use; found at http://vasc.com/wp-content/uploads/2013/07/VSI-Radial-Arm-Board-IFU-US-42-0836-01-rC.pdf; accessed and downloaded Aug. 17, 2015.

* cited by examiner

*Primary Examiner* — Keri J Nelson
(74) *Attorney, Agent, or Firm* — Law Offices of Damon L. Boyd, PLLC

(57) ABSTRACT

The present disclosure describes systems and methods for a patient arm support system for medical procedures such as radial catheterization. The support system has a body support board upon which a patient's body rests and an arm support board upon which the patient's arm rests. A pivot plate is provided that is connected to the body support board by a radial pivot hinge such that the pivot plate is rotatable throughout various rotational angles, (Θ), relative to the body support board. The support system may have an elevational hinge connecting the pivot plate and the arm support board such that the arm support board can be elevated an elevational angle (α) from the pivot plate. The support system may have an arm board stand. The support system may have a rotational bearing material between the pivot plate and the body support board.

17 Claims, 8 Drawing Sheets

ADJUSTABLE PATIENT ARM SUPPORT SYSTEM

FIELD

The present disclosure relates generally to devices, systems and methods for facilitating medical procedures such as radial catheterization.

BACKGROUND

With the advance of modern medicine, more and more, interventional medical procedures such as arterial catheterization are used to access a patient's vascular system, heart and the like. For example, procedures such as trans-radial medical device implantation of devices and therapeutic treatment such as stents, grafts, stent-grafts, as well as mapping and drug delivery, and the like are commonly done through radial catheterization. In such procedures, the patient is typically placed in a supine position, and the radial artery of the patient's arm is catheterized for such procedures. Benefits such as increased patient comfort and decreased complications and cost can be realized by such radial catheterization. Trans-radial procedures are often desirable over more traditional femoral procedures because they can be more comfortable and less invasive to the patient and have shorter recovery times, especially trans-radial procedures performed via the left arm of a patient which is more similar to traditional femoral procedures than those performed via the right arm, in part because the vascular route that procedures in the right arm are more complex.

To facilitate such procedures, various arm support devices may be provided. Such devices include "arm boards," which are generally simple, flat boards of fixed or limited mobility of the board in any direction, that are attached to an operating table or placed under the patient and extend alongside or outwardly from the patient. Generally, such boards are in the same or nearly the same plane as the patient's body. This aspect, coupled with the fact that such boards do not readily move to different positions means that notwithstanding some of the benefits of radial catheterization, doctors and practitioners performing such procedures are frequently required to perform the procedures from less than desirable positions and angles relative to the patient.

For example, the rooms and equipment used for such trans-radial procedures are often set up so that practitioner performs the procedure from the patient's right side. When procedures are performed on the patient's right arm, the angles and positions the practitioner must perform from are straightforward. However, as noted above, procedures performed via the right arm are less desirable than those in the left. Thus, left arm procedures are preferred. However, because the practitioner typically works from the right side of the patient, left arm procedures using traditional equipment require the practitioner to lean over the patient, creating the noted undesirable positions and angles, and further, exposing the practitioner to additional radiation which is often used during such procedures for locating and tracking the medical devices within the patient. Attempts to avoid these problems include using pillows for support, strapping the arm across the body, and other less than desirable approaches.

As such, there is a need for improved devices, systems and methods for facilitating medical procedures such as radial catheterization, for example, by providing such devices having improved mobility and positioning functionality.

SUMMARY

In general, the present disclosure is directed at devices and systems for a patient arm support system for medical procedures such as radial catheterization. The support system may comprise a body support board upon which a patient's body rests and an arm support board upon which the patient's arm rests. A pivot plate is provided that may be connected to the body support board by a radial pivot hinge such that the pivot plate is rotatable throughout various rotational angles ($\Theta$) relative to the body support board. The support system may further comprise an elevational hinge connecting the pivot plate and the arm support board such that the arm support board can be elevated an elevational angle ($\alpha$) from the pivot plate. The support system may further comprise an arm board stand. The support system may further comprise a rotational bearing material between the pivot plate and the body support board.

Methods of performing medical procedures and supporting a patient arm during the procedure in accordance with the present disclosure comprise placing a body support board on a procedure table then having a patient lay on the body support board in a supine position. The left arm of the patient is placed on an arm support board and extended orthogonally to the patient's body. The arm is catheterized and then the arm support board and the arm is rotated toward the body and elevated to an elevational angle ($\alpha$) such that a wrist of the arm is above the body. The arm support board and arm are rotated over the body and an arm support stand is placed between the body support board and the arm support board to maintain the arm support board in position.

BRIEF DESCRIPTION OF THE DRAWINGS

The accompanying drawings are included to provide a further understanding of the disclosure and are incorporated in and constitute a part of this specification, illustrate embodiments of the disclosure, and together with the description serve to explain the principles of the disclosure, wherein like numerals denote like elements and wherein.

DETAILED DESCRIPTION OF THE ILLUSTRATED EMBODIMENTS

Figure 1:
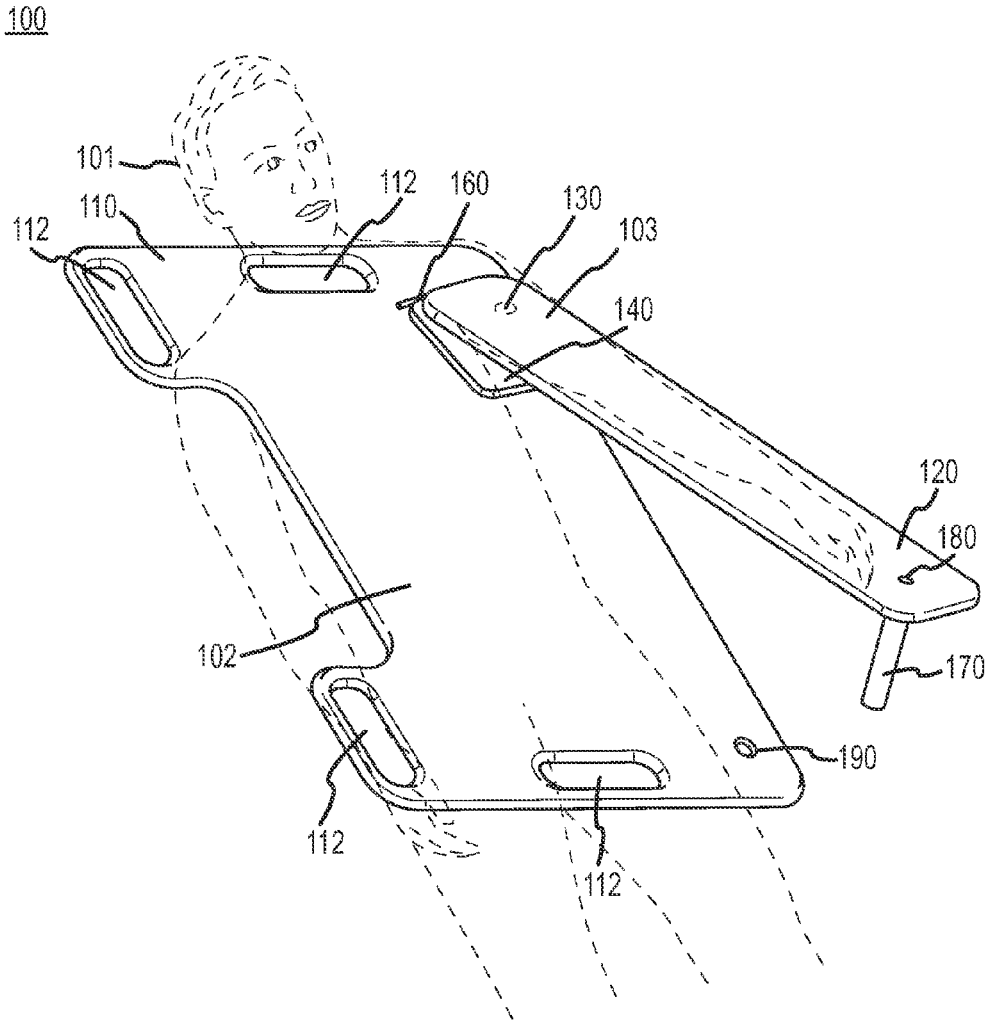
FIG. 1 is a perspective view of a patient arm support system in accordance with the present disclosure.

Persons skilled in the art will readily appreciate that various aspects of the present disclosure can be realized by any number of methods and systems configured to perform the intended functions. Stated differently, other methods and systems can be incorporated herein to perform the intended functions. It should also be noted that the accompanying drawing figures referred to herein are not all drawn to scale, but can be exaggerated to illustrate various aspects of the present disclosure, and in that regard, the drawing figures should not be construed as limiting.

As used herein, a "board" refers to any device that creates a surface suitable for supporting an object, such as a patient's body, including the torso, head, or one or more limbs. Such boards may be generally planar, but also may be non-planar. For example, a board may have a contour to its surface to facilitate comfort and patient access as described herein.

As used herein, a "catheter" is any device suitable for passage through the vasculature to a treatment site. For example, a catheter can facilitate transfer of various devices and materials to a treatment site such medical devices, tools, lights, and/or various therapeutic agents.

In accordance with various aspects of the present disclosure, patient arm support systems are provided to facilitate medical procedures such as radial catheterization. For example, such systems may include a body support board upon which all or a portion of patient's body or torso rests, typically in a generally supine position. One or more arm support boards are suitably affixed to the body support board in such a manner that the arm support board may move with respect to the body support board in two or more degrees of motion. For example, in accordance with various aspects of the present disclosure, the arm support board may pivot radially with respect to the body support board around a pivot point, thereby allowing the arm to extend away from and back proximate to the body while maintaining support from the arm board, and the arm support board may also be raised elevationally relative to the body of the patient, typically while the arm is proximate the body though not necessarily at that time, thereby raising the arm, and particularly, the wrist of the patient relative to the patient's body, and further allowing the wrist to be rotated over the patient's body, closer to a practitioner or doctor on the right side of the patient.

In accordance with various aspects of the present disclosure, the arm board may also be configured to allow other degrees of motion. For example, the body support board and arm board may be affixed to one another to allow longitudinal or axial sliding, rotational movement along an axis of the arm board itself, or other types of motion and any combination thereof. By providing such degrees of motion, doctors and practitioners may be provided easier and more comfortable access to patients and patients likewise may be provided more comfort during such procedures. Additionally, the safety, speed, accuracy, and efficacy of such procedures may be increased, while decreasing potential complications of such procedures.

Figure 2:
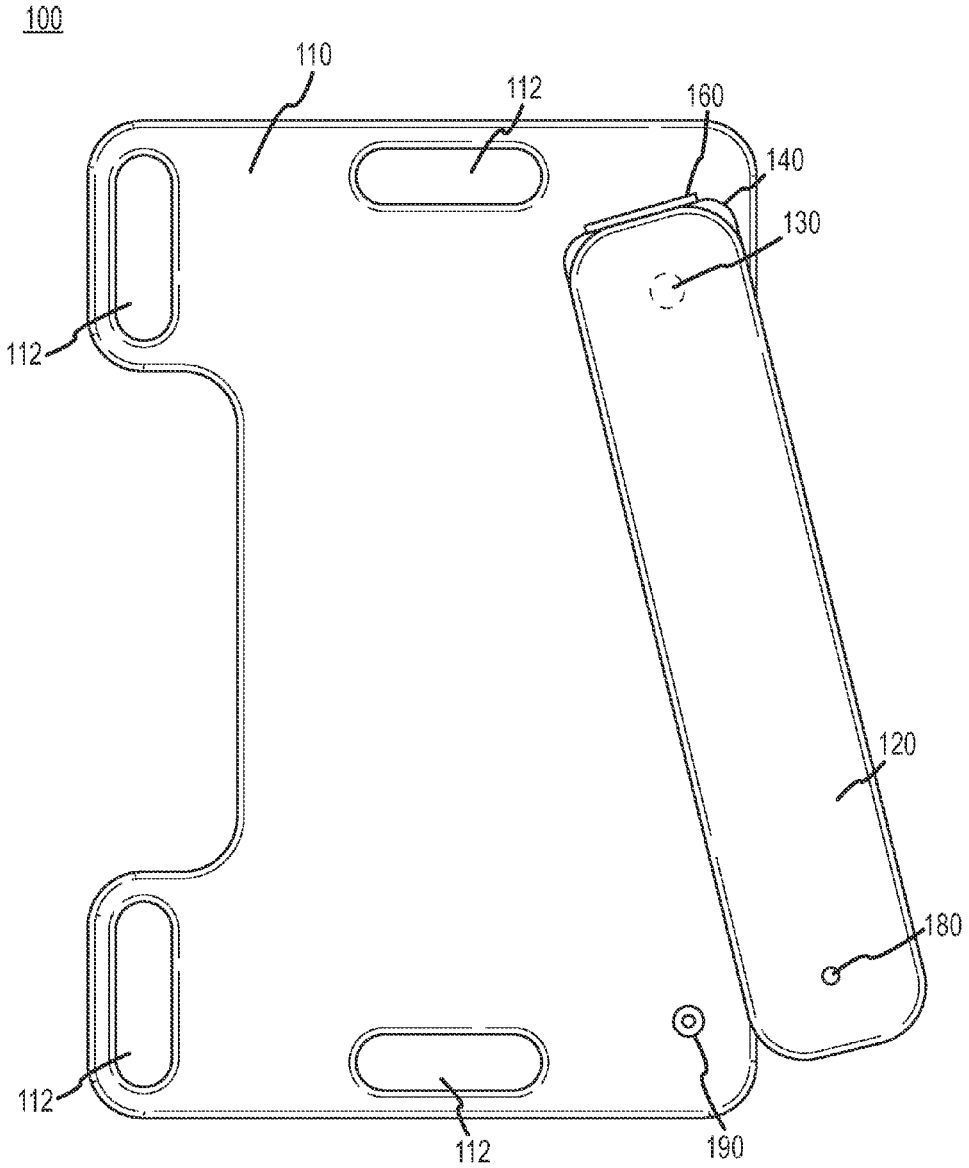
FIG. 2 is a top view of the patient arm support system of FIG. 1.
Figure 3:
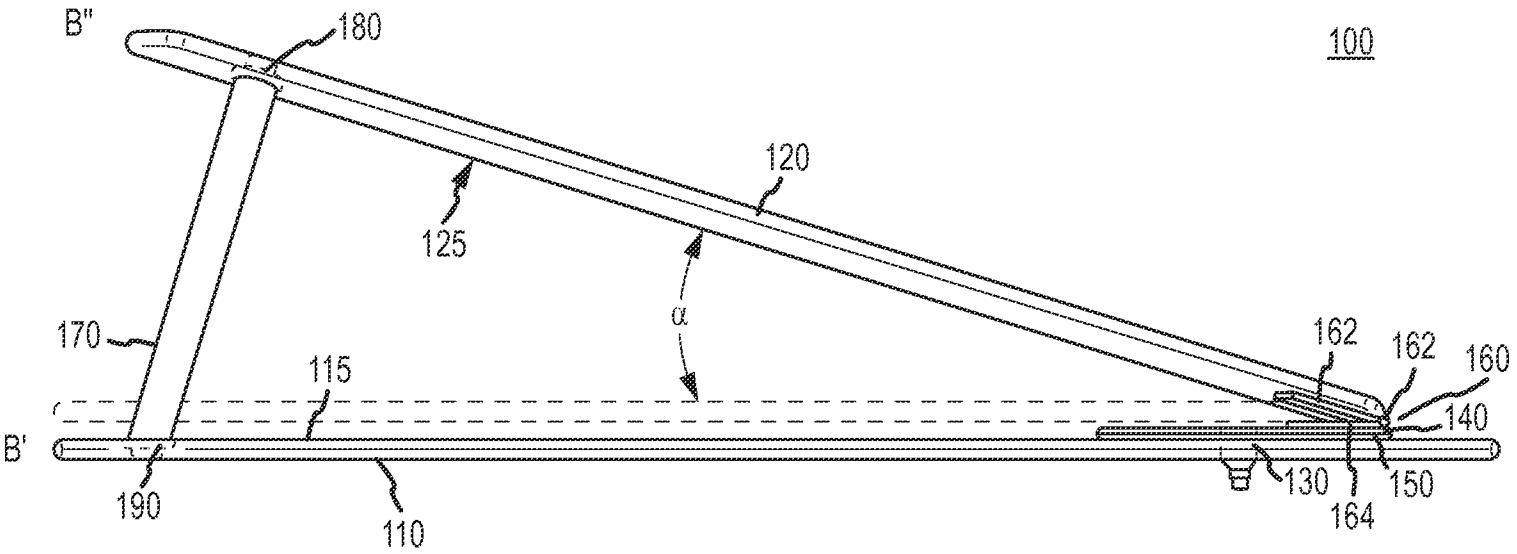
FIG. 3 is a side view of a patient arm support system showing an arm support board and a body support board rotating with respect to one another through a range of elevational angles (a) in accordance with the present disclosure
Figure 4:
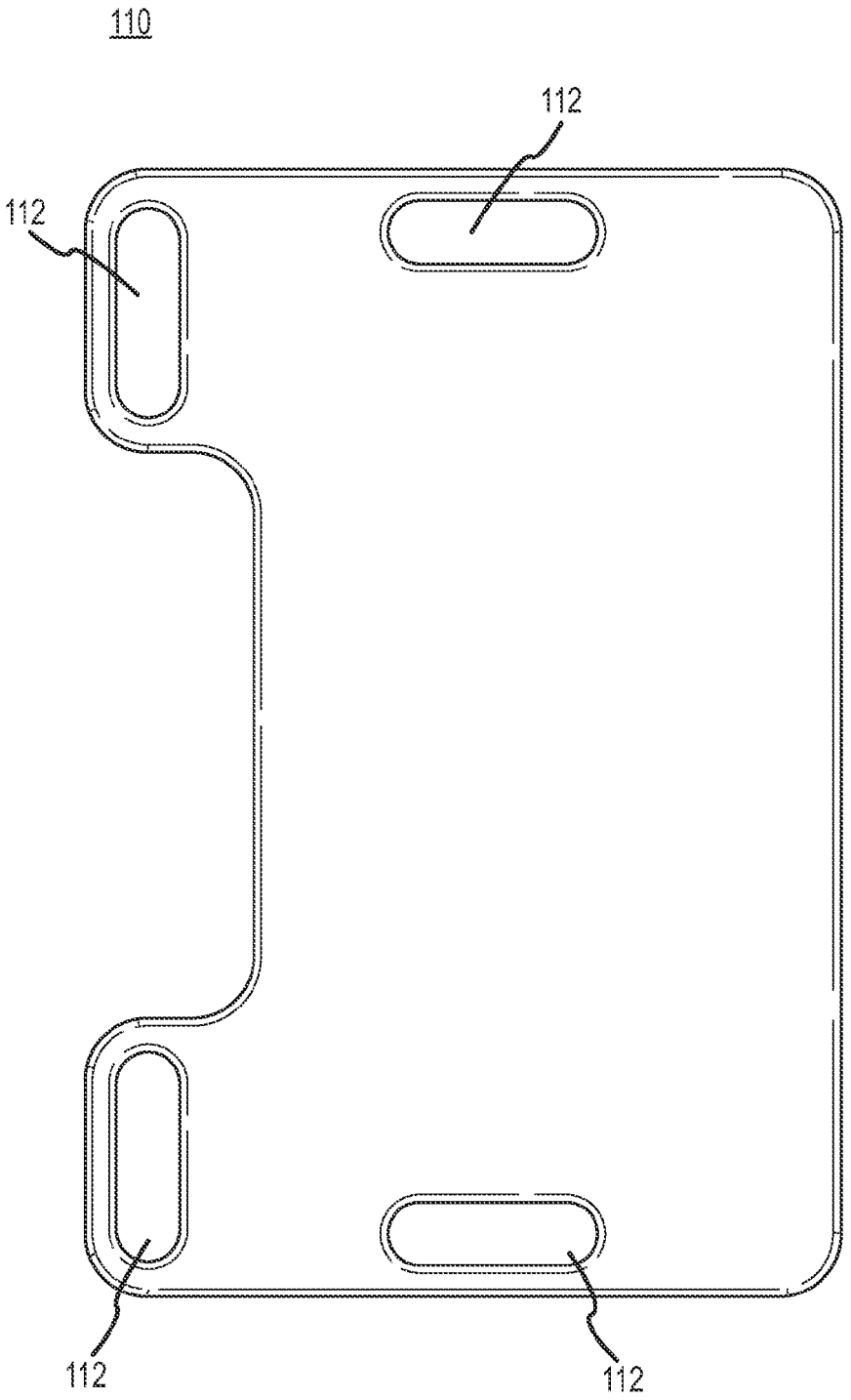
FIG. 4 is a top view of a body support board in accordance with the present disclosure.

With reference now to FIGS. 1-3, an exemplary patient arm support system 100 for facilitating a radial catheterization is illustrated. The illustrated arm support system 100 may include a body support board 110 and an arm support board 120. The body support board 110 and the arm support board 120 may be any suitably rigid board capable of supporting the body 102 and limbs, such as an arm 103, of a patient 101. For example, exemplary materials include various biocompatible polymers such as acrylic, polyethylene, polyester, polycarbonate, Lexan®, Delrin®, Makrolon®, and the like. Other suitable materials may include metals such as aluminum, stainless steel, and other alloys. In various embodiments, such materials may be generally biocompatible, and are readily capable of sanitization or sterilization for re-use.

Body support board 110 may be configured in various sizes for a variety of patient sizes. For example, larger body support boards 110 may be used for adult males and larger females, while smaller body support boards 110 may be used for more typical adult females or smaller males, and still others may be sized for children and/or infants. Body support board 110 may be substantially planar, but may also be configured with various non-planar contours to facilitate body placement of the patient 101 and/or facilitate comfort of the patient. In various embodiments and with reference to FIGS. 1-4, body support board 110 may also have one or more apertures 112 suitable for grasping, carrying, and/or positioning body support board 110.

In various embodiments, the body support boards 110 are configured to be approximately "torso-sized" such that they fit under and sufficiently beyond the approximate torso area of the patient 101 being treated. In various embodiments, the body support board 110 is wide enough such that when the arm 103 of the patient 101 is placed proximate the body 102 of the patient 101, the arm 103 at least partially overlaps the body support board 110. However, in various alternative embodiments, when the arm 103 of the patient 101 is placed proximate the body 102 of the patient 101, the arm 103 does not overlap the body support board 110.

Figure 5:
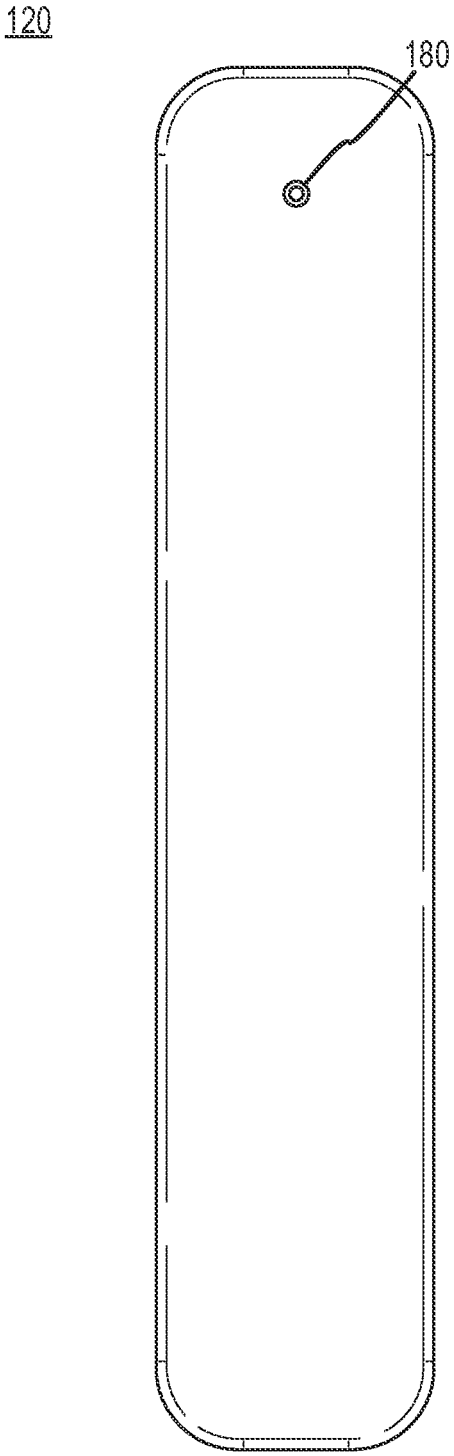
FIG. 5 is a top view of an arm support board in accordance with the present disclosure.

Referring now to FIG. 5, in various embodiments arm support board 120 may be configured in various sizes for a variety of arm 103 sizes. For example, larger arm support boards 120 may be used for adult males and larger females, while smaller arm support boards 120 may be used for more typical adult females or smaller males, and still others may be sized for children and/or infants. Arm support board 120 may be substantially planar, but may also be configured with various non-planar contours to facilitate body placement of the patient 101 and/or facilitate comfort of the patient. In various embodiments, the arm support boards 120 are configured to be sufficiently larger than "arm-sized" such that they fit under and extend sufficiently beyond the approximate arm 103 area of the patient 101 being treated.

As mentioned above, in accordance with various aspects of the present disclosure, arm support boards 120 are suitably affixed to body support boards 110 in a manner that the arm support board 120 may move with respect to the body support board 110 in two or more degrees of motion.

Figure 6:
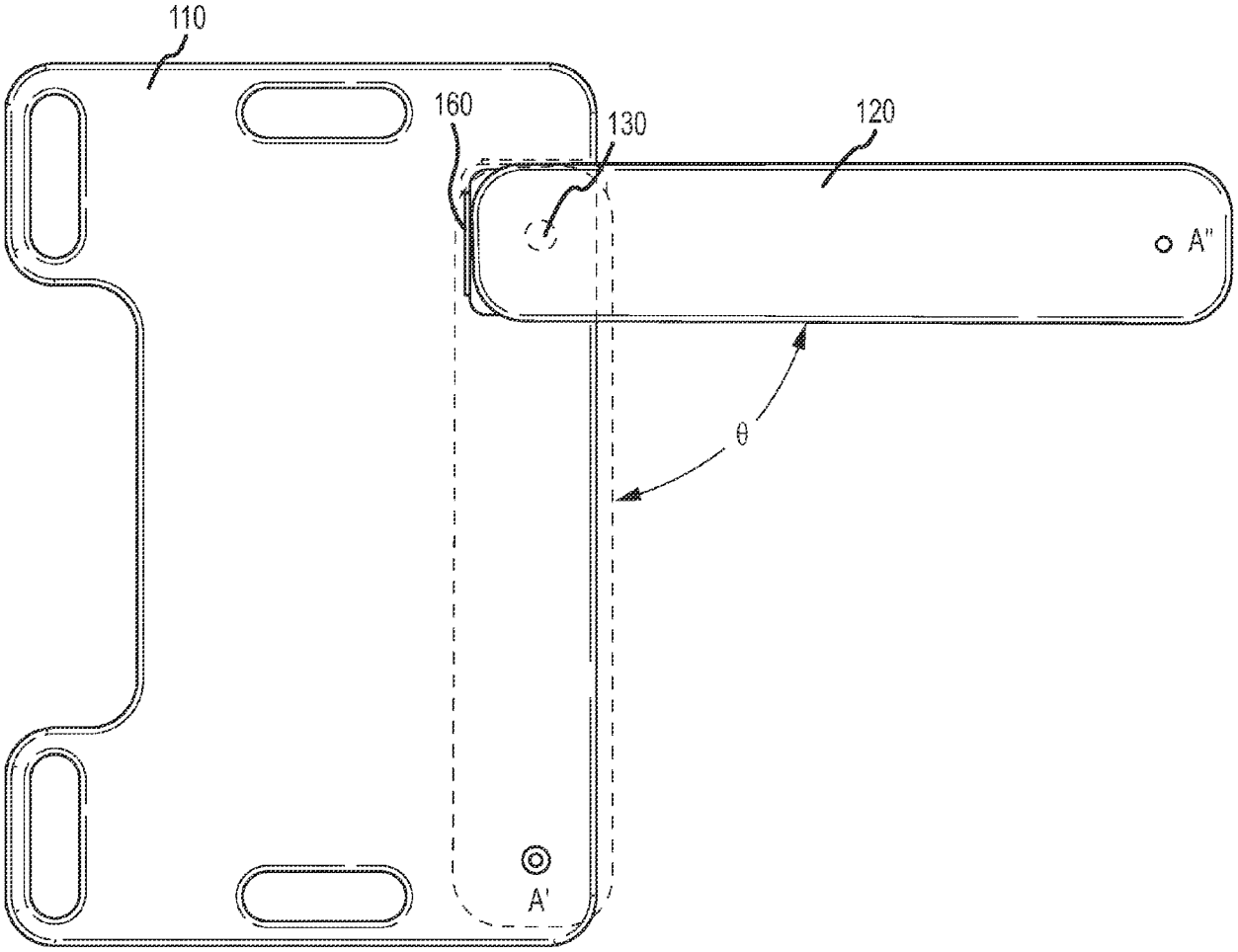
FIG. 6 is a top view of a patient arm support system showing an arm support board and a body support board pivoting with respect to one another through a range of rotational angles ($\Theta$) in accordance with the present disclosure.

For example, with reference now to FIGS. 3 and 6, arm support board 120 is affixed to body support board 110 by a radial pivot hinge 130 connected to body support board 110, which allows arm support board 120 to rotate with respect to body support board 110 about radial pivot hinge 130. Pivot hinge 130 may be any now known or as yet unknown hinge mechanism which allows two members to rotate with respect to one another about an axis, typically, though not necessarily, within the same or nearly the same plane. For example, nut, bolt, screw and washer combinations that allow such rotation fall within the scope of the present disclosure.

For example, FIG. 6 illustrates a top view of arm support system 100 and the pivoting of arm support board 120 about radial pivot hinge 130. As illustrated, in position A', arm support board 120 is proximate the body 102 of patient 101. In the illustrated embodiment, arm support board 120 partially overlaps body support board 110, though that need not always be the case. Arm support board 120 may be pivoted at a rotational angle (Θ) with respect to the body 102 to position A". In various embodiments, rotational angle (Θ) may be any desirable angle, though in the illustrated embodiment angle rotational (Θ) varies between about 0° (arm 103 alongside body 102) and about 90° (arm 103 orthogonal to body 102).

In accordance with various embodiments, various components that facilitate and/or assist with the rotational movement of arm support board 102 may be provided. Additionally, such components may also provide additional structure for facilitating additional degrees of motion of arm board 102.

Figure 7:
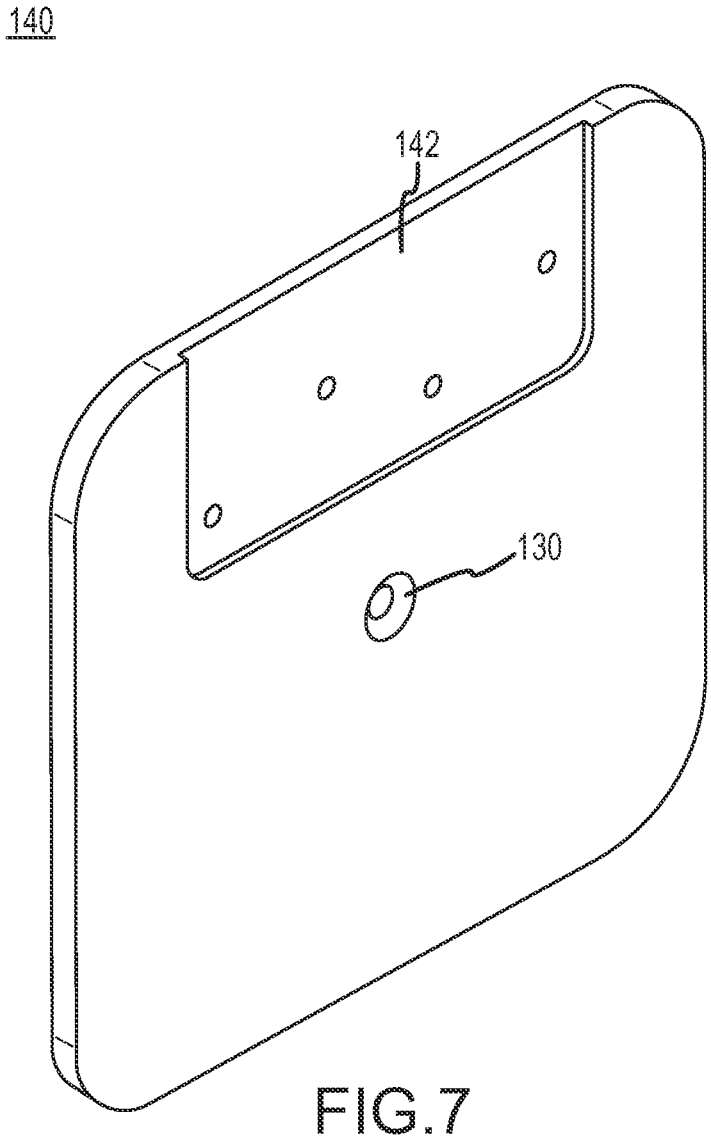
FIG. 7 is a perspective view of a pivot plate in accordance with the present disclosure.
Figure 8:
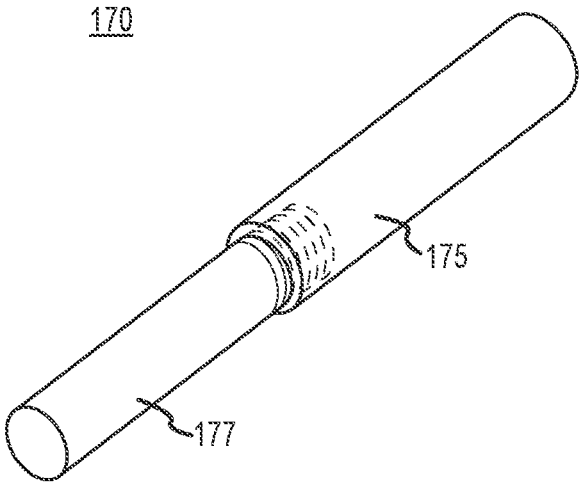
FIG. 8 is a perspective view of an adjustable arm board stand in accordance with the present disclosure.

For example, a pivot plate 140 and, optionally, a rotational bearing material 150 may be provided. With reference to FIG. 3 as well as FIG. 7, pivot plate 140 may be any suitably rigid board capable of connection to body support board 110 by rotational pivot hinge 130 such that pivot plate 140 and body support board 110 rotate about radial pivot hinge 130 with respect to one another.

Pivot plate 140 may be any suitable material strong enough to support arm support board 120, which, as described in more detail herein, may be hingedly connected to pivot plate 140. For example, exemplary materials include various biocompatible polymers such as acrylic, polyethylene, polyester, polycarbonate, Lexan®, Delrin®, Makrolon®, and the like. Other suitable materials may include metals such as aluminum, stainless steel, and other alloys. In various embodiments, such materials may be generally biocompatible, and are readily capable of sterilization for re-use.

As noted above, a rotational bearing material 150 may also be provided. With reference to FIG. 3, rotational bearing material 150 may be a surface and/or a coating affixed to body support board 110 upon which pivot plate 140 rotates. In various embodiments, rotational bearing material 150 is a material that decreases friction between pivot plate 140 and rotational bearing material 150 so that pivot plate 140 rotates about radial pivot hinge 130 more freely—i.e., with less resistance. For example, in one embodiment, rotational bearing material 150 is polytetrafluoroethylene (PTFE), though other suitable materials that reduce friction may also be used.

Alternatively, in other embodiments, rotational bearing material 150 may be configured from other materials that serve to increase friction and/or facilitate locking or reducing the rotational movement of pivot plate 140 (and thus, arm support board 120). For example, rotational bearing material 140 may increase the friction such that pivot plate 140 tends to stay in a particular position (e.g., 90° from the body) unless sufficient force is applied to rotate pivot plate 140. In other embodiments, pivot plate 140 and rotational bearing material may have a series of interlocking features or "teeth" such as projections and depressions (not shown) that interlock that help resist, though not completely prevent, rotational motion about pivot hinge 130. Other such rotation prevention features now known or as yet unknown also fall within the scope of the present disclosure.

As noted above, various components in accordance with the present disclosure may also provide additional structure for facilitating additional degrees of motion of arm board 102. For example, the arm support board 120 may also be raised elevationally relative to the body of the patient, thereby raising the arm, and particularly, the wrist of the patient relative to the patient's body. In this regard, in some embodiments, an elevational hinge 160 may be provided. In various embodiments, elevational hinge 160 is any now known or as yet unknown hinge mechanism which allows two members to rotate with respect to one another about an axis, typically, though not necessarily, other than within the same or nearly the same plane.

For example, with reference to the non-limiting embodiment illustrated in FIGS. 1-3, an elevational hinge 160 is shown. In this embodiment, elevational hinge 160 comprises a first portion 162 connected to arm support board 120 by any suitable mechanism (e.g., screws, bolts, adhesives, and the like) and a second potion 164 connected to body support board 110 by similar suitable mechanisms. First and second portions 162, 164 may be connected to body supports board 110 and arm support board 120 in recesses 142 for receiving first and second portions 162, 164. First and second portions 162, 164 are connected by a pin 166 that allows first and second portions 162, 164 to rotate as noted above, thus allowing arm support board 120 and body support board to rotate as well.

FIG. 3 in particular illustrates a side view of arm support system 100 and the elevation of arm support board 120 about elevational hinge 160. As illustrated, in position B', arm support board 120 is proximate the body support board 110. In the illustrated embodiment and with reference to FIG. 1, arm support board 120 partially overlaps body support board 110, though that need not always be the case. Arm support board 120 may be elevated away from body support board 110 at an elevational angle ($\alpha$) with respect to the body 102 to position B". In various embodiments, elevational angle ($\alpha$) may be any desirable angle, though in the illustrated embodiment elevational angle ($\alpha$) varies between about 0° (arm support board 120 proximate body support board 110) and about 45° (arm support board 120 elevated from body support board 110), and as described herein, procedures are often performed at angles of about 30°.

In accordance with various aspects of the present disclosure, mechanisms for maintaining arm support board in a desired, elevated position (e.g., elevational angle ($\alpha$)) are provided. For example, with reference to FIGS. 1-3 and 8, an arm board stand 170 is shown. Arm board stand 170 may be any suitable material strong enough to support arm support board 120 at the desired elevational angle $\alpha$. For example, exemplary materials include various biocompatible polymers such as acrylic, polyethylene, polyester, polycarbonate, Lexan®, Delrin®, Makrolon®, and the like. Other suitable materials may include metals such as aluminum, stainless steel, and other alloys. In various embodiments, such materials may be generally biocompatible, and are readily capable of sterilization for re-use.

In the embodiment illustrated in FIG. 3, arm board stand 170 is a rod-shaped member of a pre-determined length which may be secured to an upper fitting 180 on a lower surface 125 of arm support board 120 and may also be secured to a lower fitting 190 on an upper surface 115 of body support board 110.

In various embodiments, upper and lower fittings 180, 190 may be any structure which securely holds arm board stand 170 in place. For example, upper and lower fittings 180, 190 may comprise a depression in the respective surfaces of arm support board 120 and body support board 110, into which the ends of arm support stand 170 are received. Additional, securement mechanisms may be used in addition to or instead of such depressions. For example, opposing polarity magnets (not shown) may be attached to or embedded in the ends of arm support stand 170 and proximate upper and lower fittings 180, 190, such that when arm support stand 170 is in place at or near upper and lower fittings 180, 190, the magnetic attraction aids in maintaining arm support stand in position. Various other mechanical means of securing arm support stand 170 in place, now known or as yet unknown likewise fall within the scope of the present disclosure.

In various embodiments, the elevational angle ($\alpha$) of arm support board 120 may be adjusted in various manners. For example, by selecting arm board stand 170 in different lengths, elevational angle ($\alpha$) may be increased or decreased. For example, choosing a longer arm board stand 170 increases elevational angle ($\alpha$), while choosing a shorter arm board stand 170 decreases elevational angle ($\alpha$).

In other embodiments, by moving upper fitting 180 or lower fitting 190 closer to or farther away from the radial pivot hinge 130 and/or the elevational hinge 160, elevational angle ($\alpha$) may be changed. For example, moving upper fitting 180 and lower fitting 190 closer to the noted hinges increases elevational angle (α), while moving upper fitting 180 and lower fitting 190 farther from the noted hinges decreases elevational angle (α). By including more than one set of fitting on the surfaces 115, 125, it may be feasible to have a range of elevational angles (α), even when using one predetermined sized arm board stand 170. By providing arm board stand 170 in different lengths, an even broader range of elevational angles (α) may be realized.

In still further embodiments, arm board stand 170 itself may be adjustable to different lengths, reducing or eliminating the need for multiple arm board stands 170 of varying lengths. For example, with reference to FIG. 8, arm board stand 170 may be telescoping, wherein one or more outer portions 175 slide over one or more inner portions 177 in a generally continuously adjustable manner, and are capable of locking in a particular position, at a desired length. In other embodiments, arm support stand 170 may be threaded and/or have threaded portions, whereby by rotating portions of arm support stand 170, the portions advance or retreat along the threads, increasing or decreasing the length of arm support stand 170.

In accordance with various embodiments, any of the forgoing manners of adjusting elevational angle (α), as well as others now known or as yet unknown may be used individually or together, and still fall within the scope of the present disclosure.

In accordance with various aspects of the present disclosure, methods of performing medical procedures and methods of supporting a patient arm during a medical procedure are provided. For example, with reference to FIG. 1, an arm support system 100 such as described herein can be used by placing the body support board 110 on a procedure table (e.g., an operating table), and having the patient 101 lay on the body support board 110 in a supine position. The patient's left arm 103 is placed on the arm support board 120. In various embodiments, the arm 103 may be secured to the arm support board 120 by various means such as straps, belts, and the like which may or may not be integral to the arm support board 120. Once the patient is in place and ready for the procedure, the arm support board 120 (and the arm 103) may be extended orthogonally to the patient 103 in order to catheterize the arm 103 for the procedure. Next, the arm support board 120 and the arm 103 is rotated back toward the body 101 and is additionally elevated to an elevational angle (α). Thus, the arm 103 is raised above the body 101, often about 30° which allows further rotation of the arm 103, and in particular, the left wrist, over the body 101, thus allowing the practitioner to perform a more preferred left arm 103 trans-radial procedure from the right side of the patient, without the necessity of dealing with undesirable positions and angles or additional exposure to radiation. The arm support board 120 is maintained at the desired angle using the arm support stand 170.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

Likewise, numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications may be made, especially in matters of structure, materials, elements, components, shape, size and arrangement of parts including combinations within the principles of the disclosure, to the full extent indicated by the broad, general meaning of the terms in which the appended claims are expressed. To the extent that these various modifications do not depart from the spirit and scope of the appended claims, they are intended to be encompassed therein.

What is claimed is:

1. A patient body and arm support system, comprising:

a patient body support board for placement under a torso of the patient, the patient body support board having a patient body support board perimeter;

an arm support board;

an elevational hinge attached to the patient body support board within the patient body support board perimeter and connecting the arm support board and the patient body support board such that the arm support board is at least partially within the patient body support board perimeter in at least one position and such that the arm support board can be elevated between a range of elevational angles (α) relative to the patient body support board;

a radial pivot hinge such that the arm support board is rotatable between a range of rotational angles (Θ) relative to the patient body support board; and an arm board stand.

2. The patient body and arm support system of claim 1, further comprising at least one of an upper fitting and a lower fitting.

3. The patient body and arm support system of claim 2, further comprising at least one stand magnet proximate at least one end of the arm board stand and at least one board magnet proximate at least one of the upper fitting and the lower fitting.

4. The patient body and arm support system of claim 1, further comprising a pivot plate.

5. The patient body and arm support system of claim 1, further comprising a rotational bearing material.

6. The patient body and arm support system of claim 5, wherein the rotational bearing material comprises PTFE.

7. The patient body and arm support system of claim 1, wherein the arm board stand has an adjustable length.

8. The patient body and arm support system of claim 7, wherein the arm board stand further comprises telescoping portions for changing a length of the arm board stand.

9. The patient body and arm support system of claim 7, wherein the arm board stand further comprises threaded portions for changing a length of the arm board stand.

10. The patient body and arm support system of claim 1, wherein the range of rotational angles (Θ) is between 0° and 90°.

11. The patient body and arm support system of claim 1, wherein the range of elevational angles (α) is between 0° and 45°.

12. A patient body and arm support system, comprising:

a patient body support board, the patient body support board having a patient body support board perimeter;

an arm support board;

a pivot plate connected to the patient body support board by a radial pivot hinge at least partially within the patient body support board perimeter, and wherein the radial pivot hinge has an axis of rotation substantially perpendicular to the patient body support board such that the pivot plate is rotatable about the radial pivot hinge in a plane substantially parallel to the patient body support board;

a rotational bearing material between the pivot plate and the patient body support board;

an elevational hinge connecting the pivot plate and the arm support board such that the arm support board can be elevated an elevational angle ($\alpha$) from the pivot plate; and an arm board stand.

13. The patient body and arm support system of claim 12, further comprising at least one of an upper fitting and a lower fitting.

14. The patient body and arm support system of claim 13, further comprising at least one stand magnet proximate at least one end of the arm board stand and at least one board magnet proximate at least one of the upper fitting and the lower fitting.

15. The patient body and arm support system of claim 13, wherein the rotational bearing material comprises PTFE.

16. The patient body and arm support system of claim 12, wherein the arm board stand further comprises telescoping portions for changing a length of the arm board stand.

17. The patient body and arm support system of claim 12, wherein the arm board stand further comprises threaded portions for changing a length of the arm board stand.

* * * * *